US006616581B2

(12) United States Patent
Gwyn

(10) Patent No.: US 6,616,581 B2
(45) Date of Patent: Sep. 9, 2003

(54) BICEPS AND TRICEPS ISOLATOR

(76) Inventor: Estes K. Gwyn, 12574 Stagecoach Rd., Walton, OR (US) 97490

( * ) Notice: Subject to any disclaimer, the term of this patent is extended or adjusted under 35 U.S.C. 154(b) by 0 days.

(21) Appl. No.: 10/007,746

(22) Filed: Nov. 9, 2001

(65) Prior Publication Data

US 2002/0072453 A1 Jun. 13, 2002

Related U.S. Application Data

(60) Provisional application No. 60/247,228, filed on Nov. 10, 2000.

(51) Int. Cl.[7] ..... A63B 71/00

(52) U.S. Cl. ..... 482/139; 128/95.1; 128/869; 2/309

(58) Field of Search ..... 482/121, 122, 482/124, 131, 134, 139, 106; 128/846, 869, 870, 876, 875, 878, 96.1, 95.1; 2/309–312

(56) References Cited

U.S. PATENT DOCUMENTS 4,629,183 A 12/1986 Perrine
4,799,675 A 1/1989 Helmer
5,069,449 A * 12/1991 Wardwell ..... 482/13
6,053,883 A * 4/2000 Schiek ..... 602/19

* cited by examiner

*Primary Examiner*—Glenn E. Richmon
(74) *Attorney, Agent, or Firm*—David L. Garrison; Garrison & Assoc. PS

(57) ABSTRACT

A muscle group isolation device for weightlifters, worn when performing weightlifting exercises primarily for the triceps and biceps to assist the weightlifter in maintaining proper arm position while exercising. The muscle group isolation device includes an elongated flexible strap with a fastening means to adjustably connect the two ends of the strap together and form a continuous loop. When a weightlifter desires to perform biceps or triceps exercises, places his or her arms through the continuous loop created by fastening said ends of the strap together, positions the fastening means so that it is on the side of the loop facing away from his or her body, and properly positions his or her arms so the pads provide a cushion between the weightlifter's arms and the strap, the loop functions to prevent any undesired outward or rearward movement of the arms while permitting movement, free of undesired restraint, through the complete range of motion of the desired exercise thus being able to isolate the effects of said exercise on the desired muscle group.

7 Claims, 3 Drawing Sheets

BICEPS AND TRICEPS ISOLATOR

CROSS-REFERENCE TO RELATED APPLICATIONS

This application claims the benefit of U.S. Provisional Application Serial No. 60/247,228, entitled Biceps and Triceps Isolator, filed Nov. 10, 2000.

TECHNICAL FIELD

This invention relates to weightlifting, and more particularly to a muscle group isolation device worn during weightlifting exercises to enhance the benefits of arm and back exercises including bicep, tricep, neck and back development exercises.

BACKGROUND OF THE INVENTION

Weightlifting is a popular and useful means of physical exercise that provides benefits to many people. Due to this popularity, a variety of devices have been developed for isolating various muscle groups so they can receive maximum benefit from various weightlifting exercises. In this way, strength, mass, or muscle tone can be developed more effectively and over a shorter period of time.

Various devices are used by weightlifters to isolate muscle groups when performing arm exercises, such as curls, for the biceps. One such device, shown in U.S. Pat. No. 4,629,183, includes a curved rigid bar made of metal or plastic which fits over the weightlifter's chest. The bar is held in place by an adjustable neck band. The ends of the bar extend outwardly from opposite sides of the body, behind and just above the elbows. The back portions of the weightlifter's arms rest against the ends of the rigid bar. The ends of the bar can have a slight curvature to conform to the back of the arms to hold them in place during use. When performing curls, the ends of the rigid bar act as a restraint to resist the forces applied during the exercise. This device attempts to keep the arms in place by preventing the elbows from drifting away from the sides of the body, thereby decreasing the effectiveness of the exercise.

This type of device suffers from several disadvantages. The wide rigid bar, which fits over the lifter's chest, digs into the chest when the ends of the bar resist the force of the weight during use. This causes painful pinching of the skin and uncomfortable pressure on the front of the chest. In addition, the lifter's arms often are not constantly held in place on the ends of the rigid bar. There is a tendency for the elbows to move outwardly when performing weightlifting exercises such as curls, and they can slip off the ends of the bar. The neck strap can cause discomfort when the device is used and there is potential for the neck strap to cause injury if the device is used improperly or the weightlifter becomes overly fatigued. This device also is not designed well for use by women. Additionally, the device was designed solely for use when conducting curls to exercise the biceps and provides no benefit during triceps extension exercises.

Another device is shown in U.S. Pat. No. 4,799,675, which comprises a flexible strap secured with velcro type fasteners. As with the device described above, a neck strap is required to position the device on the chest of the user. The ends of the strap are then routed behind and around the user's arms before being separately fastened to the back central portion of the strap, thereby holding a weightlifter's arms in two separate, cuff-type loops. This device functions by locking a weightlifter's arms in a controlled position at the sides of the user for curl and similar biceps exercises.

This device is essentially a flexible version of the bar type device, described above, that adds the improvement of being able to lock the arms in position. As with the bar type device, the neck strap can cause discomfort when the device is used and there is potential for the neck strap to cause injury if the device is used improperly or the weightlifter becomes overly fatigued.

When using the strap described above, weightlifters with large upper arms require assistance to fasten the ends of the strap to the back central portion of the strap in order to use the device properly. If a weightlifter with large upper arms fastens the ends to the central portion with no assistance, he or she will not be able to achieve the proper arm position to receive maximum benefit from the exercise. As with the bar type device, there is no teaching of the use of this device for triceps extensions and other exercises wherein the arms are not at the sides of the weightlifter, but rather move through an arc overhead and in front of the weightlifter. Additionally, the presence of the neck strap and the requirement that the device function to hold the arms rigidly fixed at the sides of the weightlifter precludes use of this device during triceps exercises.

The present invention provides a muscle group isolation device for weightlifters which overcomes the disadvantages of the prior arm locking devices and which also provides additional improvements in accomplishing the desired results of numerous additional arm exercises beyond the biceps curls for which the arm locking devices are intended.

DISCLOSURE OF THE INVENTION

This invention provides a muscle group isolation device for use by weightlifters which includes an elongated flexible strap which is substantially non stretchable in its axial dimension. An adjustable fastening means, such as a buckle, is provided on one or both ends of the strap, adjustably holding the ends of the strap in fixed positions, relative to each other, so that the strap forms one continuous loop. The strap is long enough so that when a weightlifter places his or her arms through the loop, formed by the strap, it wraps both arms of the weightlifter behind the triceps and over the biceps and allows the weightlifter to keep his or her arms in the desired position for the exercise being conducted. When the weightlifter's arms are through the loop, the fastening means is positioned on the side of the loop facing away from the weightlifter's torso (the front of the loop), and approximately centered between the arms. The right and left ends of the loop are padded for the weightlifter's comfort and the pads are slidably attached to the strap so the position of the pads may be effectively altered to meet the size needs of the weightlifter.

Before exercising the biceps or triceps, the weightlifter adjusts the loop to the desired size, inserts his or her arms through the loop, and positions the arm pads so they engage the weightlifter's arms approximately midway between the elbows and the shoulders. Used in this manner, the strap assists the weightlifter in maintaining the desired distance between his or her arms, thereby permitting the weightlifter to properly perform exercises designed to address development and strength needs for specific muscles such as biceps, triceps and other upper body muscle groups during weightlifting exercises.

During use, the strap creates no resistance to the normal lifting action, and assists the weightlifter in maintaining the proper position of the arms. As a result, the effect of the weightlifting exercises can be isolated on many specific muscle groups for training and enhancement thereof.

The flexibility of the strap allows the weightlifter to exercise with heavy weights without a metal bar painfully pinching his or her chest. Unlike the prior art, the current invention does not use a neck strap to hold it in position, thereby eliminating the risk of neck pain or injury caused by the invention. The invention can be used to assist the weightlifter in the proper performance of more exercises than could be accomplished using devices disclosed in the prior art.

BEST MODE OF CARRYING OUT THE INVENTION

Figure 1:
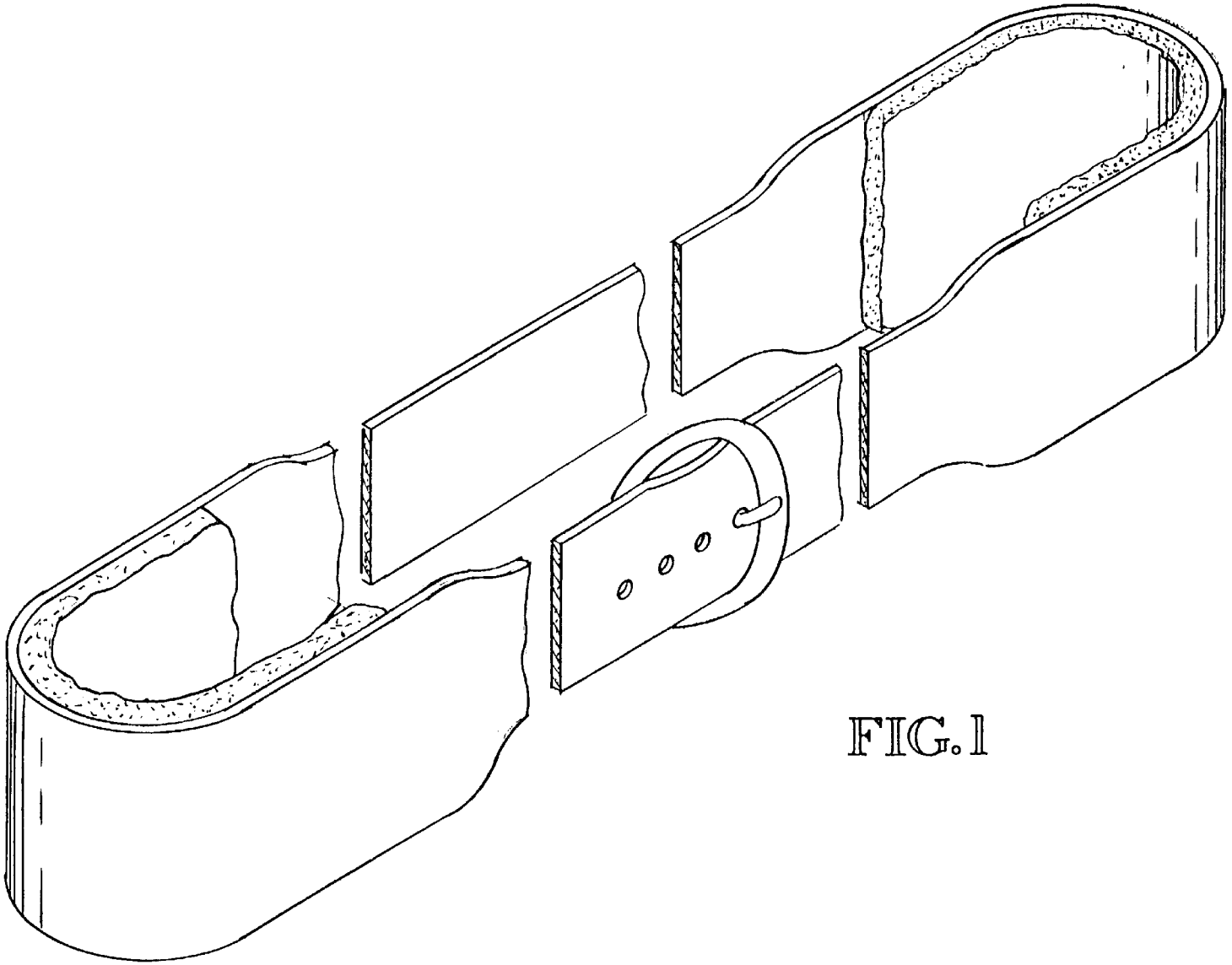
FIG. 1 is a perspective view showing a muscle group isolation device according to principles of this invention.

Referring specifically to the drawings wherein like figures indicate like parts, there is seen in FIG. 1 one embodiment of the muscle group isolation device which may be used in numerous exercises. The device includes an elongated flexible strap 12 which is preferably of uniform width from end to end. The strap is preferably made from heavy leather or may be constructed of well-known woven nylon belting materials which are not significantly stretchable during use. The strap 12 has ends 14 and 16 that can be overlapped and adjustably connected by a fastening means. In the embodiment depicted, the fastening means is a buckle 18. Other adjustable fastening means may be used in different embodiments including, friction type buckles, hook pile type fastening devices and other means that would be obvious to those skilled in the art.

Figure 2:
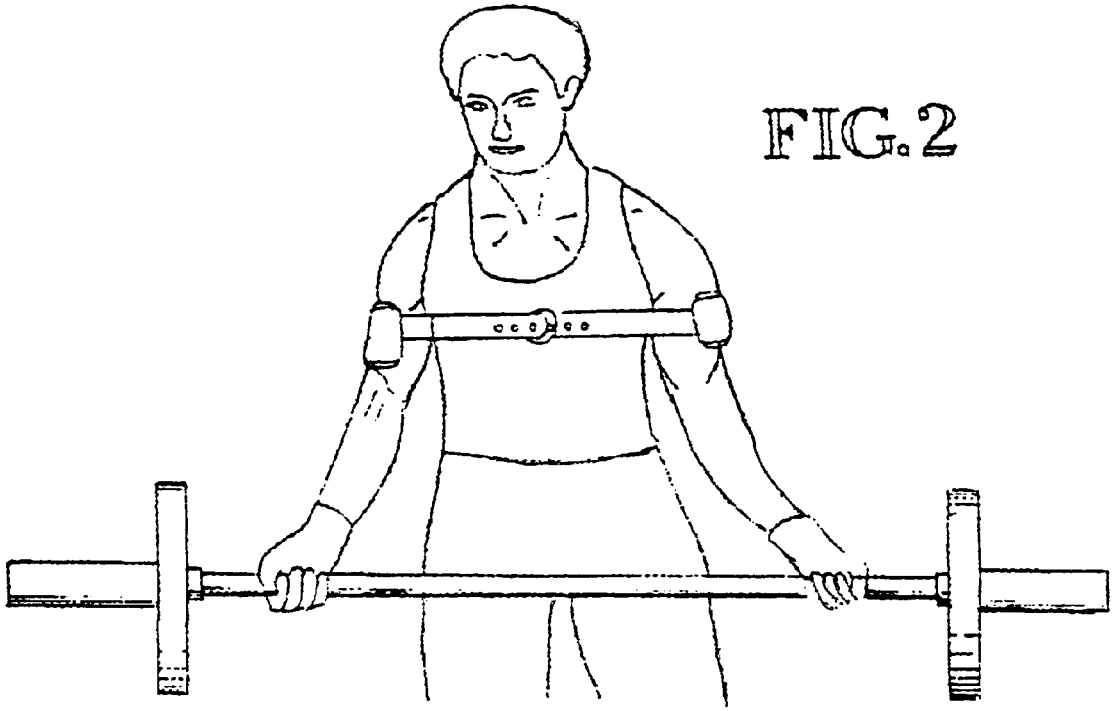
FIG. 2 is a front view illustrating the invention during use in biceps curl exercises in a standing position.
Figure 3:
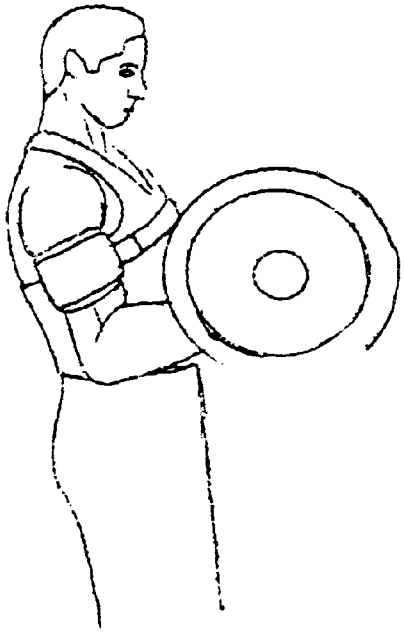
FIG. 3 is a side view of the device of this invention being used for biceps curls in a standing position.
Figure 4:
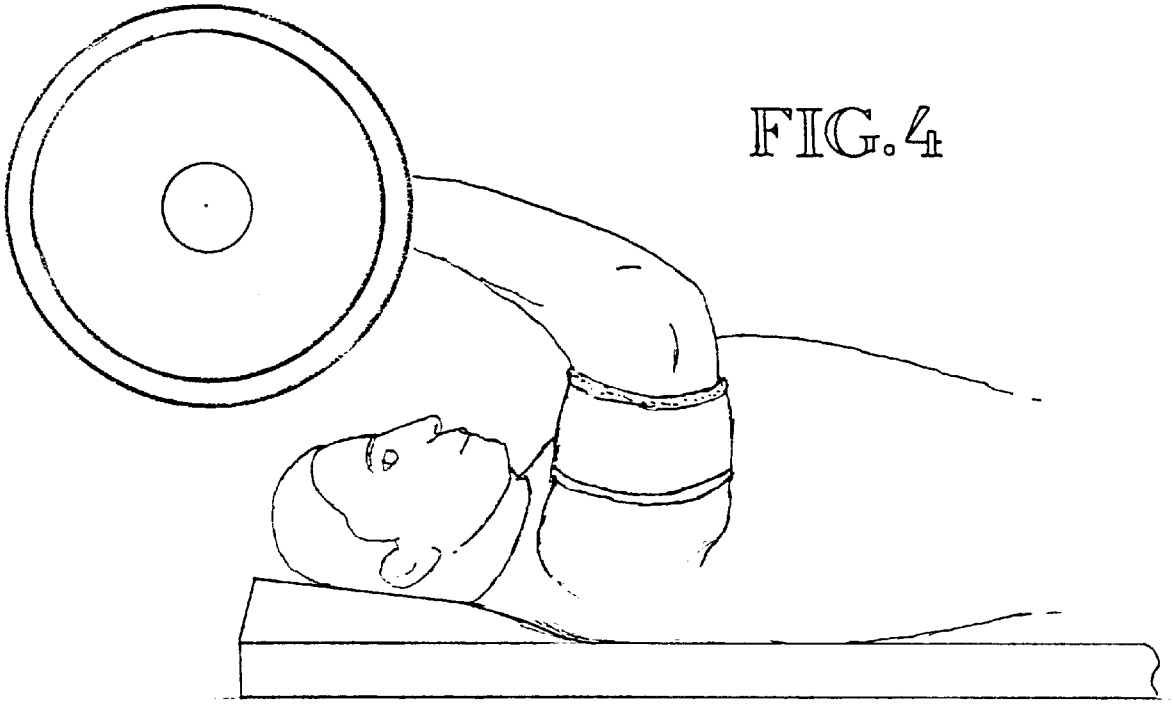
FIG. 4 is a side view of the device of this invention being used for triceps extension exercises with the weightlifter's arms overhead.

To prepare the strap for use, the weightlifter connects the ends of the strap 12 and 14 using buckle 18 to hold them in a fixed position relative to each other and thereby forms a loop having ends 17 and 19. The strap 12 is of sufficient length that when the weightlifter places his or her arms through the loop, the strap will assist the weightlifter in maintaining the arms in the position desired for the exercise being conducted as depicted in FIGS. 2–4. The ends of the loop 17 and 19 include pads 24 and 26 for the weightlifter's comfort. During use, the buckle 18 is positioned on the side of the loop away from the weightlifter's body and approximately centered between the weightlifters arms. As the weightlifter performs the exercise, the back portion of the loop 28 contacts his or her chest but does not create any resistance to the normal lifting action due to the flexible nature of the strap.

FIG. 2 illustrates the use of the muscle group isolation device during the performance of standing curls used to exercise the biceps. The buckle 18 is located on the side of the loop away from the weightlifter's body and approximately centered between the weightlifter's arms. In the embodiment depicted, pads 24 and 26 are slidably attached to the strap 12. The weightlifter's arms 31 and 33 are held tight to the weightlifter's sides thereby allowing the weightlifter to get the maximum benefit of the exercise. FIG. 3 shows a side view of a weightlifter performing standing curls. Strap 12 keeps the weightlifter's arm 31 from rotating outward or back. FIG. 4 is a side view of the device of this invention being used for triceps extension exercises with the weightlifter's arms overhead.

For example, a weightlifter wanting to perform biceps curls would first determine what size of loop he would need to make with the strap 12 so that he would be able to hold his arms tight to his sides when he is performing the exercise. The weightlifter would then adjust the loop using buckle 18, and insert his arms through the loop with buckle 18 facing away from his torso (see FIG. 2). As the weightlifter performs the exercise, he would bring the weight to his chest and lower it to the arms extended position (see FIG. 2 and FIG. 3). The ends 17 and 19 of the loop keep the weightlifter's arms from rotating away from his torso, while the rear portion of the strap 28 rests against the weightlifter's chest and prevents his arms from moving rearward. This allows the weightlifter to maintain the proper arm position and receive maximum benefit from the exercise.

In another example, a weightlifter wanting to perform triceps extensions would first determine what size of loop he would need to make with the strap 12 so that he would be able to hold his arms in the correct position (see FIG. 4). The weightlifter would then adjust the loop using buckle 18, and insert his arms through the loop with buckle 18 facing away from his torso. As the weightlifter performs the exercise, he rotates the weight upward until his arms are extended straight out from his chest and then he lowers the weight to the position show in FIG. 4. The ends 17 and 19 of the loop keep the weightlifter's arms from rotating away from his torso, while the rear portion of the strap 28 rests against the weightlifter's chest and prevents his upper arms from moving to his sides. This allows the weightlifter to maintain the proper arm position and receive maximum benefit from the exercise.

Unlike devices disclosed in the prior art, the muscle group isolation device does not have a neck strap so there is no potential for the device to place excess pressure on the neck, during the performance of biceps exercises, thereby causing discomfort or possibly injury. Additionally, unlike some devices disclosed in the prior art, a weightlifter can use the current invention to perform biceps curls with out requiring another person to assist in properly fastening the device so as to lock his arms at his sides. Furthermore, unlike the prior art devices discussed above, the invention allows a weightlifter to use the device to enhance the benefits of triceps exercises.

In the embodiments depicted in the figures and described above, once the weightlifter places his or her arms through the continuous loop created by fastening the ends 14 and 16 of the strap 12 together, the separation of the arms is set so as to prevent any undesired outward or rearward movement of the arms while permitting movement, free of undesired restraints, through a complete range of motion for the desired exercise. The muscle group isolation device leaves the arms entirely free from any undesired restraint so that arm exercises such as triceps extensions, biceps straightbar and hammer curls, cable pushdowns, can be preformed without any resistance caused by the device. The strap 12 being substantially inflexible in length resists any tendency of the arms to separate during use. Thus, the weightlifting exercise can be isolated on specific muscles because of this means for controlling the positions of the arms during use.

INDUSTRIAL APPLICABILITY

The invention has applicability to the field of exercise devices, in particular, this invention describes a device for isolating the muscle groups in a weightlifter's arms, that allows the weightlifter to perform exercises for a variety of muscle groups while maintaining the proper arm position needed to receive maximum benefit from the exercises.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

What is claimed is:

1. A muscle group isolation device for use during weightlifting, comprising:

an elongated flexible strap which is substantially non-stretchable in its axial dimension, said strap having a first end and a second end;

fastening means for adjustably connecting said ends of said strap to each other so as to form a continuous loop configured to allow a user to isolate the biceps or triceps muscles for concentrated exercises; and a pair of pads, said pads being positioned on said strap such that when said user's arms are placed through the loop created by fastening said ends of said strap to each other, said pads provide a cushion between a weightlifter's arms and said strap; and whereby when said user desires to perform biceps or triceps exercises places his or her arms through said continuous loop created by fastening said ends of said strap together, positions said fastening means so that it is on the side of the loop facing away from his or her body, and properly positions his or her arms so said pads provide a cushion between said user's arms and said strap, the loop functions to prevent any undesired outward or rearward movement of the arms while permitting movement, free of undesired restraint, through the complete range of motions of the desired exercise thus being able to isolate the effects of said exercise on the desired muscle group.

2. The device of claim 1 wherein said strap is made of leather.

3. The device of claim 1 wherein said fastening means is a buckle placed on either of said ends of said strap.

4. The device of claim 1 wherein said pads are slidably attached to said strap and moveable therealong.

5. The device of claim 1 wherein said pads are made of an elastically yielding, compressible, and shape restoring foam material.

6. A muscle group isolation device for use during weightlifting comprising:

an elongated flexible strap made of leather, said strap having a first end and a second end;

a buckle placed on either of said ends or said strap for connecting said ends of said strap to each other so as to form a continuous loop configured to allow a user to isolate the biceps or triceps muscles for concentrated exercise;

a pair of pads said pads are made from an elastically yielding, compressible, and shape-restoring foam material;

said pads are slidable attached to said strap and moveable there along; and whereby when said user desires to perform biceps or triceps exercises, places his or her arms through said continuous loop created by fastening said ends of said strap together, positions said buckles so that it is on the side of the loop facing away from his or her body, properly positions his or her arms, and slidably adjusts said pads so said pads provide a cushion between said user's arms and said strap, the loop functions to prevent any undesired outward or rearward movement of the arms while permitting movement, free of undesired restraint, through the complete range of motions of the desired exercise, thus being able to isolate the effects of said exercise on the desired muscle group.

7. A method for isolating a weightlifter's muscle groups during weightlifting, comprising the steps of:

selecting a target muscle group to be isolated for exercise from the group consisting of biceps or triceps;

selecting a muscle group isolation device that has an elongated flexible strap which is substantially non-stretchable in its axial dimension, said strap having a first end and a second end; a fastening means for adjustably connecting said ends of said strap to each other so as to form a continuous loop; a pair of pads, said pads being positioned on said strap such that when said weightlifter's arms are placed through the loop created by fastening said ends of said strap to each other, said pads provide a cushion between a weightlifter's arms and said strap;

placing the weightlifter's arms through said continuous loop created by fastening said ends of said strap together;

positioning said buckle so that it is on the side of the loop facing away from said weightlifter's body;

positing said arms for commencement of said exercise; and slidably adjusting said pads so said pads provide a cushion between said arms and said strap, whereby said loop functions to prevent any undesired outward or reward movement of said arms while permitting movement, free of undesired restraint, through the complete range of motions of said exercise, thus being able to isolate the effects of said exercise on the desired muscle group.

* * * * *